United States Patent [19]

Bourque

[11] 4,384,413

[45] May 24, 1983

[54] MOLDED PLASTICS SKATE BOOT

[75] Inventor: Rene' Bourque, Duvernay, Canada

[73] Assignee: Gamebridge Inc., Quebec, Canada

[21] Appl. No.: 162,511

[22] Filed: Jun. 24, 1980

[51] Int. Cl.[3] ..... A43B 5/04

[52] U.S. Cl. ..... 36/115; 36/120

[58] Field of Search ..... 36/115, 114, 120, 118, 36/121

[56] References Cited

U.S. PATENT DOCUMENTS 3,861,067 1/1975 Koyama et al. ..... 36/120

FOREIGN PATENT DOCUMENTS 1066500 11/1979 Canada ..... 36/115

1097062 3/1981 Canada .

*Primary Examiner*—Patrick D. Lawson

*Attorney, Agent, or Firm*—Schwartz, Jeffery, Schwaab, Mack, Blumenthal & Koch

[57] ABSTRACT

A unitary one-piece molded plastic skate, for use with ice or roller skate runners, has a lower shell portion and an upper portion shell portion with the upper shell portion comprising a tendon guard and side ankle flaps, the tendon guard portion of the upper being integrally molded to form a hinge with the rear heel portion of the lower portion. The side ankle flaps overlap upward extensions of side walls of the lower shell portion. A mold apparatus for forming the one-piece skate boot and said mold apparatus including a core formed to the inner shape of the skate boot and having an upstanding leg portion with the thin walled sleeve fixed to the upstanding portion and having a downwardly extending skirt which, in the molding operation, is in contact at the edge thereof with the mold cavities so as to form the flaps of the upper portion but to leave a hinge portion at the heel rear.

4 Claims, 13 Drawing Figures

MOLDED PLASTICS SKATE BOOT

BACKGROUND OF INVENTION

1. Field of the Invention

The present invention relates to boot constructions, and particularly to a skate boot made of molded plastic material.

2. Description of Prior Art

In conventional plastic skate boots, it is necessary to provide a first lower portion including a sole made of rigid plastics material and a hinged anklet or upper. The hinged anklet is pivoted to the lower portion, normally about an axis below the ankle of one's foot. The lower portion per se is designed such that the heel portion thereof extends only up to a person's ankle while the upper portion gives protection and support for the remaining height of a normal skate boot, including the tendon guard. A skate boot requires both rigidity in the lower portion in the lateral direction but flexibility in the longitudinal plane of the skate boot as well as laterally in the area of the ankle. Such conventional plastics boots provide a limited amount of lateral rigidity and longitudinal and upper flexibility and are normally a compromise of both.

SUMMARY OF INVENTION

It is an aim of the present invention to provide an improved one-piece plastic skate boot, with improved lateral rigidity in the lower portion, and uncompromised longitudinal and lateral flexibility for the wearer's foot and ankle.

It is a further aim of the present invention to provide a one-piece molded plastic boot in which the upper is hinged to the lower to allow the upper to flex relative to the lower.

It is a further aim of the present invention to provide a mold for producing a one-piece plastics boot having the upper portion relatively independent from the lower portion and hinged thereto.

It is an aim of the present invention to provide a simpler and more inexpensive method of producing skate boots or the like in which the lower portion and upper are formed in one step, thus reducing the cost of producing the boot, yet providing a boot with superior flexibility where required.

In the present description, a molded lower portion includes the sole, sides, heel and lacing area, that of the lower shell of the boot. The upper portion is the separate anklet and tendon guard which is hinged to the lower portion.

A construction in accordance with the present invention comprises a boot including a molded lower portion comprising a toe, sole, side walls and heel portion, and a molded upper portion integrally connected at the rear of the heel of the lower portion and including forwardly extending flaps overlapping the side walls and a rear upward tendon guard extension. The flaps extend towards the front of the boot and define with the lower portion, an access opening and securing means for closing said opening and firmly securing said lower portion and upper portion to the foot of a wearer.

In a more specific embodiment of a boot in accordance with the present invention, the heel portion of the lower portion includes a thickened portion at the hinge with the upper portion, the heel of the lower portion merges with the top edge of the side walls and defines a plane which extends upwardly and forwardly from the hinge area to terminate and merge with the edges of the side walls defining the access slot forming the access opening of the lower portion. The upper portion has flaps which overlap the upstanding side walls and which terminate at the access slot defined by the side walls and are sufficient to cover the ankle of a wearer of the boot.

An apparatus for forming a one-piece molded boot in accordance with the present invention includes a pair of molds adapted to separate at the median plane extending along the longitudinal axis of the boot to be formed, each mold piece having a cavity adapted to the outer contour of the boot to be formed, a core insertable in the mold cavities, the core including a first member in the form of a foot and a second member in the form of a sleeve affixed to the rear of the core first member and including a frontwardly and downwardly extending skirt in the area of the side walls to be formed, the skirt overlapping and being spaced from the wall surface of the first member of the core for forming the side wall extensions of the lower portion underlapping the flaps of the upper portion.

BRIEF DESCRIPTION OF DRAWINGS

A preferred embodiment of the present invention will now be described with reference to the examples thereof illustrated in the accompanying drawings in which.

DESCRIPTION OF PREFERRED EMBODIMENTS

Figure 1:
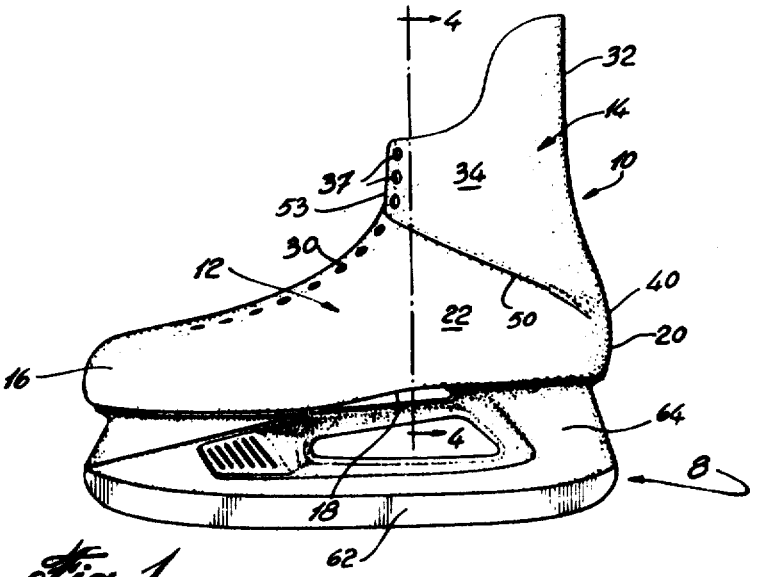
FIG. 1 is a side elevation of a skate boot in accordance with the present invention.

Referring now to FIGS. 1 through 5, there is shown a skate boot 10 to which is attached a blade 8 such that the skate can be used for ice skating. An identical boot 10 can be provided with a roller skating truck for the purposes of utilizing the boot for roller skating.

The boot 10 includes a lower portion 12 and an upper portion 14. The lower portion includes a toe 16, a sole 18, and a heel 20 as well as side walls 22 and 24. Each side wall 22 and 24 defines an access opening at the metatarsal area by means of the edges 26 and 28. Along the edges 26 and 28 are typical eyelets 30 for the purpose of passing a lace.

Figure 5:
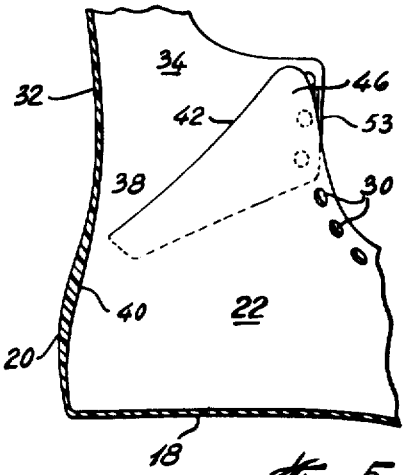
FIG. 5 is a vertical cross-section taken along the line 5—5 of FIG. 4.
Figure 7:
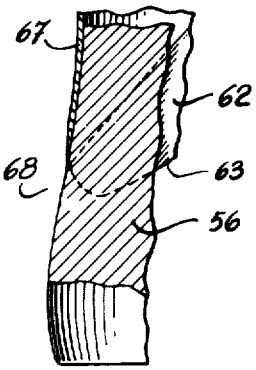
FIG. 7 is a vertical fragmentary cross-section taken along line 7—7 of FIG. 6.
Figure 8:
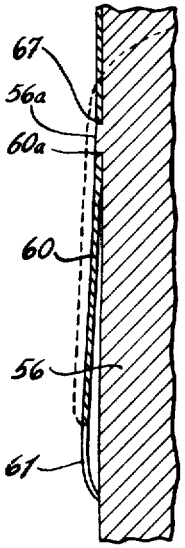
FIG. 8 is a vertical cross-section taken along line 8—8 of FIG. 6.

The heel 20, as shown in FIG. 5, has a thickened material portion at the hinge area 40 and extends into the tendon guard 32 wall portion of the upper portion 14 on the other hand. The tendon guard portion 32 is integral with the lower portion only in the hinge area 40. The upper portion 14 has frontwardly extending ankle protecting flaps 34 and 36 defined by lower edges 50 and 52 respectively. The front edges 53 and 55 define an extension of the access opening, and eyelets 37 for laces are provided near these edges 53 and 55.

Figure 2:
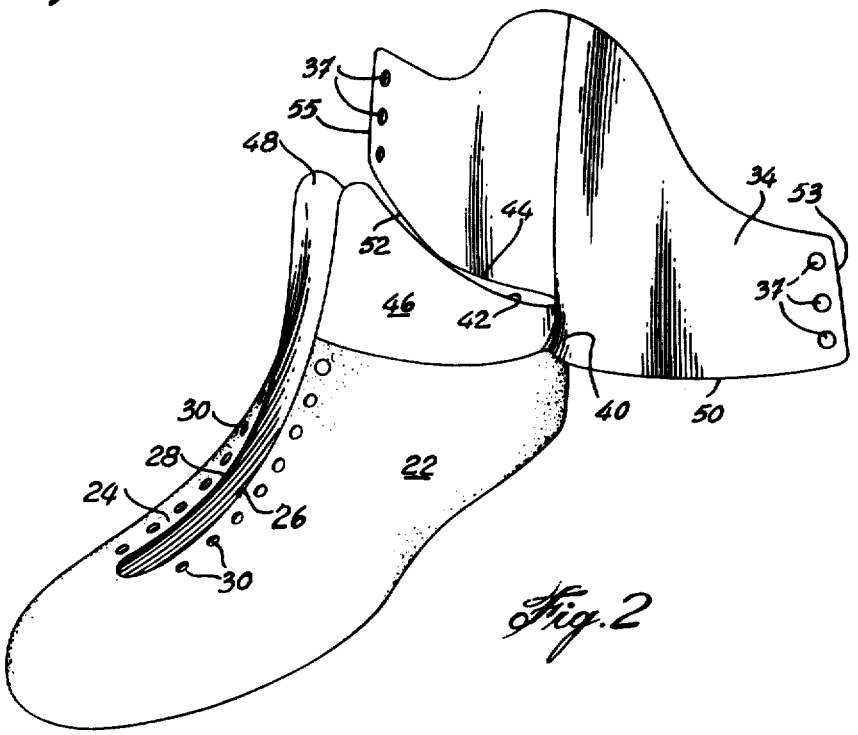
FIG. 2 is a perspective view of the boot of FIG. 1 taken from the front and top thereof with an element of the boot in a different position.
Figure 3:
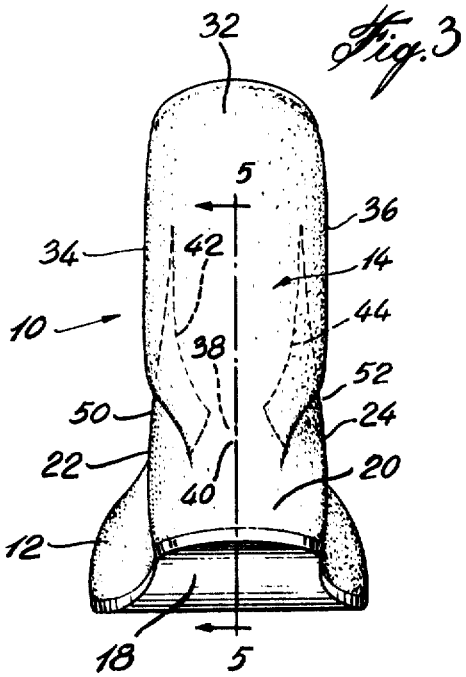
FIG. 3 is a rear elevation of the boot shown in FIG. 1.
Figure 4:
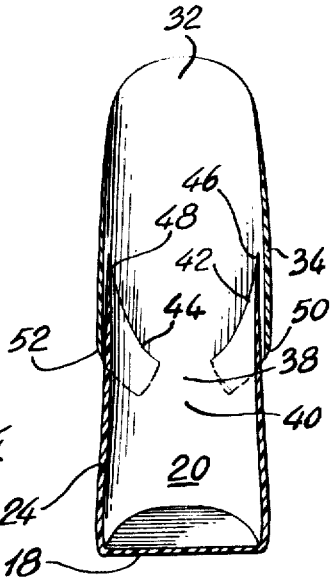
FIG. 4 is a vertical cross-section taken along the line 4—4 of FIG. 1.
Figure 6:
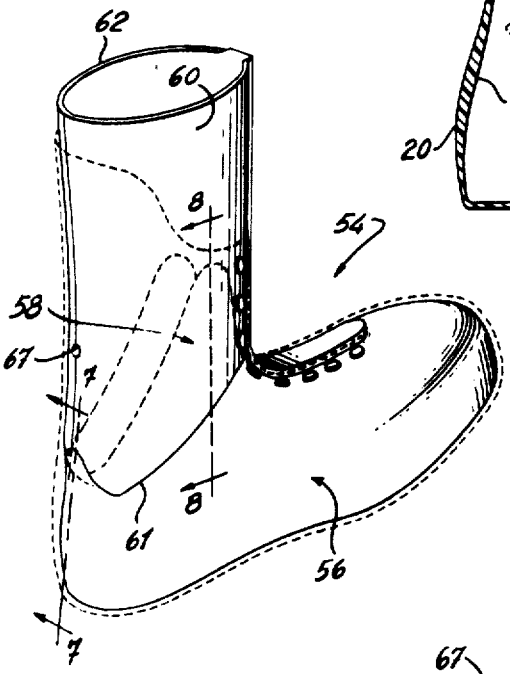
FIG. 6 is a perspective view of a core used in the molding of the boot.

As can be seen in FIG. 2, the flaps can move completely independently of the side walls 22 and 24 and overlap upwardly extending portions of the side walls 22 and 24 as indicated by the upward extensions 46 and 48 respectively. The top edge of the side walls of the lower portion 12 is defined by the numerals 42 and 44. The outline of the underlapped side wall extensions 46 and 48 is shown in dotted lines in FIGS. 1 and 3.

As can be seen from the drawings and the above description, the upper portion 14 has a hinging movement in the longitudinal direction of the boot, thereby giving the wearer good longitudinal flex. The lower portion, including the side walls 22 and 24, can be relatively rigid by increasing the thickness of the material forming the side wall, but the upper portion portion of the boot, including the flaps 34 and 36, has some lateral flexing freedom in the area of the ankle, particularly since the edges 50 and 52 of the upper are not attached to the lower 12.

Figure 9:
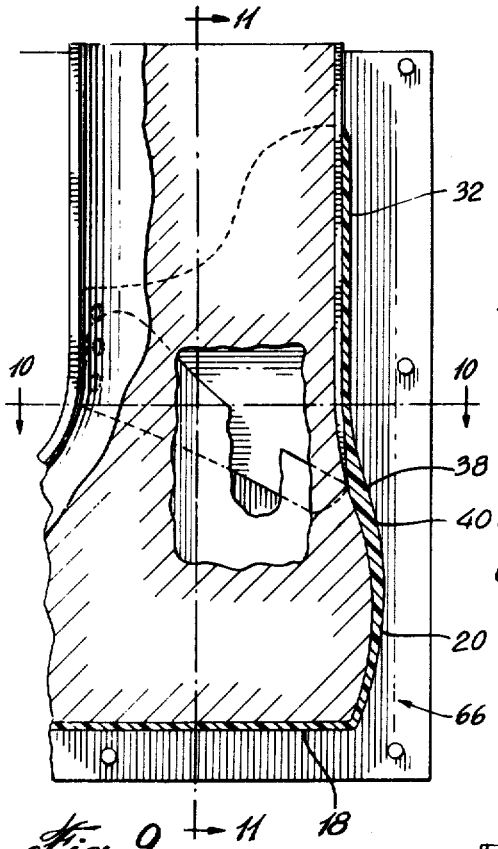
FIG. 9 is a fragmentary view taken in the plane of separation of the mold apparatus showing the core partially in cross-section and partly removed.
Figure 10:
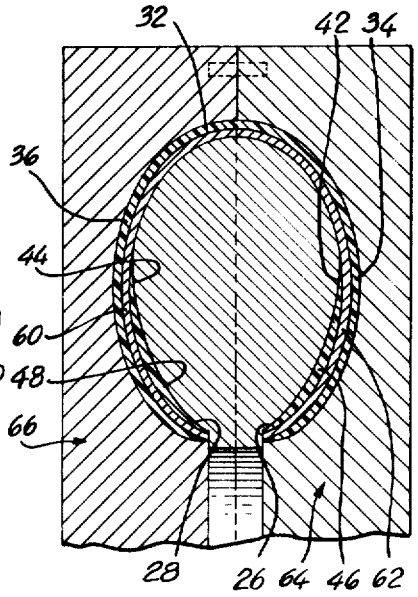
FIG. 10 is a vertical cross-section taken along line 10—10 of FIG. 9.
Figure 11:
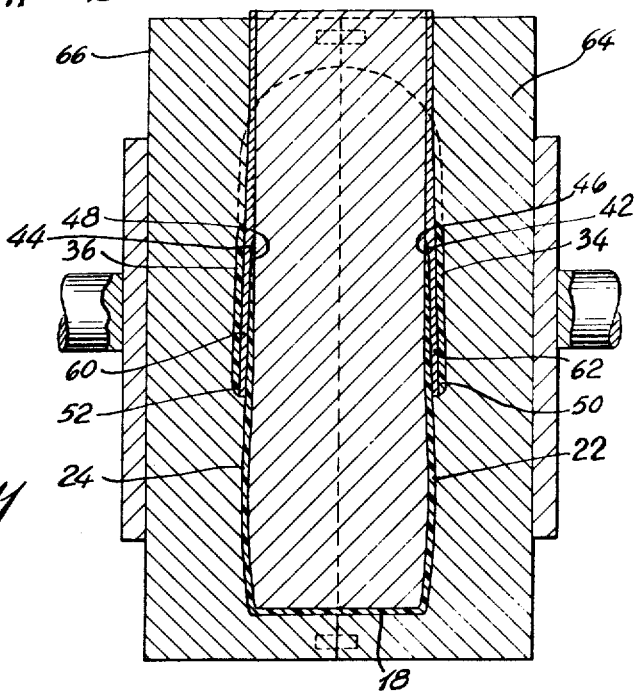
FIG. 11 is a vertical cross-section taken through the mold at 90° to the plane of separation thereof and somewhat along the line 11—11 of FIG. 9.

The manufacture of this one-piece skate boot 10 is made possible by the use of the core 54 illustrated along with conventional mold cavities 64 and 66, as shown in FIGS. 9 through 11. The core has a foot portion 56 to which is attached a flexible thin-walled sleeve portion 58 which is connected or rivet-welded to the foot portion 56 at the rear and sides thereof, for instance, at 67. Rivet welding includes the provision of apertures 60*a* in the sleeve 60 and projections 56*a* on the core portion 56. The projections 56*a* protrude through the apertures 60*a* and are welded at 67. The sleeve members 60 and 62 on either side forming part of the sleeve 58 are connected at the front to a core projection such that a space is left between the sleeve members 60 and 62 and the surface of the core 56. When plastics material is being injected into the mold, it extends between the sleeve portions 60 and 62 and the surface of the core 56 to form the upward extensions 46 and 48 of the side walls 22 and 24 respectively, as shown in FIG. 11.

The skirt edge 61 and 63 is the bottom edge of the sleeve members 60 and 62. When it is necessary to form the boot 10, the core 56 with the sleeve 58 is located in the mold cavities 64 and 66 which are then closed on either side of the core 56 and plastics material is injected therein to form the boot. The mold cavity is selected such that it is in contact with the sleeve skirt edges 61 and 63 at the bottom edge thereof to define the flap edges 50 and 52, as shown in FIG. 11. Likewise, the top portion of the sleeve is in contact with the core 56 to define the top edges of the side wall projections such as at 42 and 44 also as shown in FIG. 11.

Figure 12:
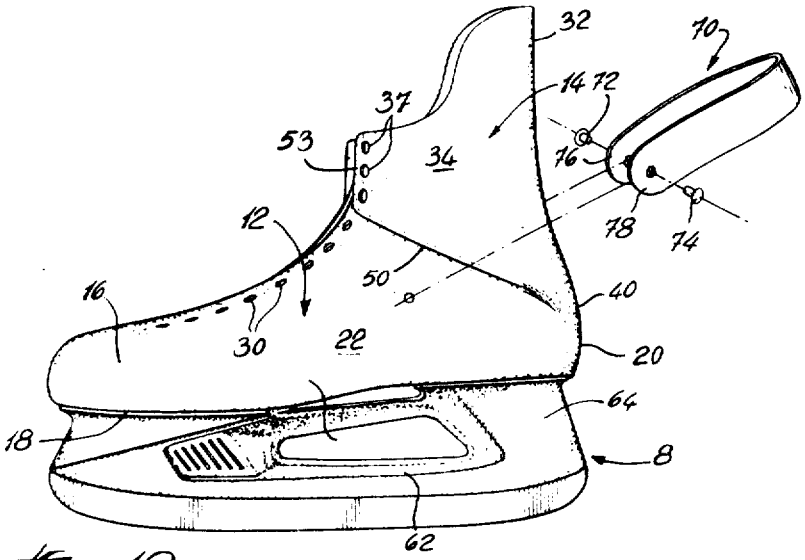
FIG. 12 is a side perspective partly exploded of another embodiment of the present invention.
Figure 13:
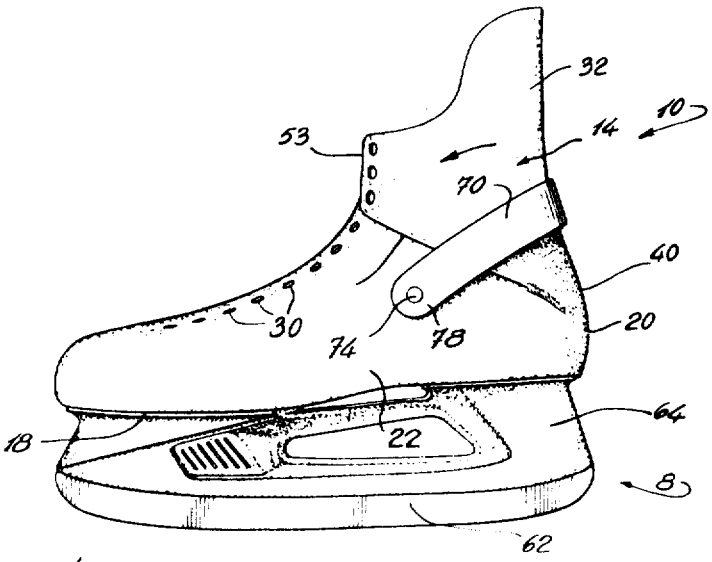
FIG. 13 is a side elevation of the skate shown in FIG. 12.

Another embodiment of the boot is illustrated in FIGS. 12 and 13. In this figure, the boot which includes the same reference numerals as in FIGS. 1 to 5, has a stop strap 70 which is anchored to the side walls 22 and 24 by means of anchor pins 72 and 74. The strap is provided for limiting backward flexing of the upper. The strap includes a pair of ends 76 and 78. The strap 70 has a generally U-shaped configuration and passes completely around the rear of the upper at the tendon guard 32. The characteristics of the boot shown in the embodiment of FIGS. 12 and 13, particularly with respect to ice skates, are similar to those provided with traditional leather skate boots. The resistance of the traditional leather skate boot to the backward flexing motion is well known. The strap 70 contributes to restricting the backward flexibility of the boot as in a leather skate boot. However, the stop strap 70 is so constructed and arranged that it does not restrict forward and lateral movement of the boot 10 of the present invention to thereby provide characteristics similar to the leather boot.

The foregoing description is provided to illustrate the present invention but is not intended to limit the scope thereof to the specific constructions set forth. Clearly, numerous additions, modifications or other changes can be made without departing from the scope of the invention as set forth in the appended claims.

I claim:

1. A one-piece skate boot comprising a molded lower portion and a molded upper portion with the upper portion connected to the lower portion by an integrally molded hinge, the lower portion including a toe portion, side walls, a sole and a heel portion, the hinge being formed at the rear of said heel portion of the lower portion with the upper portion, the upper portion including a rear tendon guard and ankle flaps extending therefrom, the hinge being integral with the tendon guard, the flaps extending towards the front of the boot and defining with the lower portion an access opening, and securing means for closing said opening and firmly securing said lower portion and upper portion to the foot of a wearer, wherein the upper portion will provide longitudinal and lateral flexibility relative to the lower portion.

2. A one-piece skate boot as defined in claim 1, wherein the top edge of the side walls of the lower portion define a plane which extends upwardly and forwardly from the hinge area to terminate and merge with the edges of the side walls defining the access slot forming the access opening of the lower portion, the flaps of said upper portion overlapping the upward and forward extensions of their side wall and terminating at the access slot defined by the side walls and are sufficient to cover the ankle of the wearer of the boot.

3. A skate boot as defined in claims 1 or 2, wherein the access opening defined by the side walls of the lower portion and the flaps of the upper portion are provided with eyelets for receiving lacing.

4. A unitary, one-piece skate boot comprising a molded lower portion, a molded upper portion, and an integral molded hinge formed unitarily with and between said upper and lower portions, said lower portion including a toe portion, side walls, a sole portion, and a heel portion, said upper portion including a rear tendon guard, and ankle flaps extending from said rear tendon guard, said hinge comprising a length of flexible material formed unitarily with and extending between the rear of said heel portion and said tendon guard.

* * * * *